US008840961B1

(12) United States Patent
Lucca

(10) Patent No.: US 8,840,961 B1
(45) Date of Patent: Sep. 23, 2014

(54) COMPOSITION AND METHOD FOR CLEANING AND LUBRICATING VALVES AND SLIDES WITHIN MUSICAL INSTRUMENTS

(76) Inventor: Salvatore Lucca, Palm Beach Gardens, FL (US)

( * ) Notice: Subject to any disclaimer, the term of this patent is extended or adjusted under 35 U.S.C. 154(b) by 504 days.

(21) Appl. No.: 13/135,275

(22) Filed: Jun. 30, 2011

(51) Int. Cl.
*B05D 5/08* (2006.01)
*B05D 7/22* (2006.01)
*B05D 3/12* (2006.01)

(52) U.S. Cl.
USPC ..... 427/314; 427/299; 427/318; 427/327; 427/346; 427/355

(58) Field of Classification Search
CPC ..... B05D 5/08; B05D 3/12; B05D 7/14; F16N 99/00; F16N 2210/00
USPC ..... 427/299, 314, 327, 346, 355, 318
See application file for complete search history.

(56) References Cited

U.S. PATENT DOCUMENTS 4,501,220 A 2/1985 Biasini et al.
4,670,174 A 6/1987 Mirkin
5,149,450 A 9/1992 Konigs
5,801,131 A 9/1998 Coffey et al.
6,425,929 B1 7/2002 Naney
6,494,928 B1 12/2002 Hokkirigawa et al.
7,374,592 B2 * 5/2008 Hasinovic et al. ..... 51/304

OTHER PUBLICATIONS

"How to Care for Wind Instruments" webpage, Canadian Conservation Institute, published Apr. 1, 2002, http://www.cci-icc.gc.ca/caringfor-prendresoindes/articles/433-eng.aspx.*

"Buffing and Polishing Brasswind Musical Instruments" webpage, publication date unknown, http://www.ebay.com/gds/Buffing-and-Polishing-Brasswind-Musical-Instruments-/10000000000110210/g.html.*

* cited by examiner

*Primary Examiner* — Kirsten Jolley
(74) *Attorney, Agent, or Firm* — Ferris H. Lander, Inc.

(57) ABSTRACT

A sticky valve or slide mechanism within a musical wind instrument is opened, wiped dry, cleaned and lubricated with a composition including diatomaceous earth, a solvent, and a lubricant, and closed, making the instrument ready to play with the composition being left within the valve or slide mechanism. When the mechanism again becomes sticky, it is wiped dry and lubricated with a conventional lubricant.

4 Claims, No Drawings

COMPOSITION AND METHOD FOR CLEANING AND LUBRICATING VALVES AND SLIDES WITHIN MUSICAL INSTRUMENTS

RELATED APPLICATIONS

Not applicable

FEDERALLY SPONSORED RESEARCH OR DEVELOPMENT

Not Applicable

BACKGROUND OF THE INVENTION

1. Field of the Invention

This invention relates to a self cleaning, self polishing, self lapping, self honing composition for piston and rotary valves, and for fast slides, which must be able to move quickly to correct intonation, as opposed to slow slides, such as tuning slides, which are set in place and occasionally reset to adjust pitch, within musical instruments, and to a method for using the composition to eliminate a tendency of such valves and slides to stick or operate slowly; without requiring significant down time of the instrument and effort of the musician.

2. Summary of the Background Information

Musicians from all over the world frequently experience problems with sticky valves used to control the pitches produced by various instruments, such as trumpets and other valve controlled instruments, with reluctant slides in trombones used to control pitch, and with fast compensating slides used to correct intonation. Over time, these problems can be caused by the formation of debris on surfaces sliding in contact with one another in the valves and slides. Although seemingly invisible, a coating formed by this debris can have deleterious effects. One form of the debris is oil residue. Like skin, metal has pores, with some metals having more of a tendency to collect residue than others, within microscopic pores. Other causes for an accumulation of debris include mineral deposits from saliva, food and beverages consumed by the musician, especially food and beverages containing sugars and starches, remaining in the mouth after eating, will find their way to the valves but will not necessarily impact the slides.

Debris on the surfaces sliding in contact within valves and slides may also be accumulated through the use of a detergent or dish washing soap containing silicones and lanolin, which are difficult to rinse away. Many musicians like to give their instruments an occasional bath with such a detergent or dish washing soap. While bathing the instrument might be suitable, surfaces sliding in contact with one another within the valves and slides should only be wiped clean.

Even if the valve or slide operates properly following cleaning, it will often operate properly as the instrument is played for a time that is much too short. While effective lubricants are widely available, this problem is often caused by a failure to clean away the entire residue left in the valve mechanism by merely wiping the surfaces dry. Such residue may include particles introduced into the instrument as it is played and sticky masses left by the previously-applied lubricant. What is needed is a fast, effective method for cleaning the valve and slide mechanisms with virtually no instrument downtime and with little effort on the part of the musician.

Products known as lapping compounds are presently marketed for fixing sticky valves within musical instruments. These products include an abrasive medium in the form of a powder, which may be emery or an ordinary variety of garnet. The emery powder is a dark, impure, and irregularly shaped variety of corundum, which is available in several grit sizes, while the ordinary variety of garnet is a hard silicate mineral crystal that can be crushed into several irregularly shaped grit sizes. According to the directions provided with such products, the contact surfaces sliding against one another are wiped dry before applying some of the compound to the movable surface. Then, after the instrument is reassembled, the valve is manually pushed up and down for 15-20 minutes, or longer if needed. The instrument is then disassembled, given a bath, dried, lubricated, and reassembled. If the problem has not been resolved, the entire process must be repeated. This process can possibly cause irreparable damage to the instrument by increasing the clearance between opposing metal parts, causing air leakage that must be compensated for by efforts of the musician, reducing his endurance. Also this process requires downtime and the active participation of the musician as part of the fix.

Slow or sticky valves or slides may be caused by means other than a lack of cleaning or a build up of solidified minerals on the metal surfaces. Mechanical problems include unevenly worn valves, dented or twisted valve casings and dented slides. Damage to sliding contact surfaces within valves and slides may additionally be caused by rotating a valve or slide, disturbing the normal wear pattern created by movement of the valve or slide upward and downward, or inward and outward. For example, damage can be caused by rotating a valve as it is inserted into a casing of an instrument. Instead, the valve guide should be aligned with the notch inside the casing, with the valve then being inserted straight down allowing about a quarter inch of the valve exposed above the casing. Then, after lubricating around the valve, the valve is fully inserted. Additionally, one leg of a slide should never be rotated back and forth in an attempt to make it move more freely. While dents and other damage that is clearly visible should be repaired by a qualified technician, what is needed is a composition that can be applied to correct microscopic damage, avoiding a repair bill.

The patent literature describes a number of examples of compositions and methods for cleaning and lubricating the valves and slides of musical instruments. For example, the application of a nontoxic and biodegradable lubricant and/or cleaning composition to the moving parts of musical instruments is described. The composition may include a nontoxic oil base, such as vegetable oil, preferably corn oil or olive oil, and a nontoxic solvent, such as ethanol, and/or a citrus solvent, such as a terpene compound. Alternately, the slide of a trombone is lubricated by applying a layer of silicone fluid, by then applying soap to the slide, and by thereafter spraying water on the slide. Alternately, a colloidal lubricant, having the lubricating characteristics without the stickiness of grease, is provided for lubricating valves in musical wind instruments. The colloidal lubricant is formed of a mixture of wax and oil, preferably mineral oil, mixed in approximately equal proportions. A device for cleaning and lubricating the valves of a musical instrument, such as a trumpet, is also described. The device includes a casing having a pair of openings, one of which has a peripheral cleaning pad, while the other has a peripheral lubricating pad. The valve is selectively inserted in both openings for cleaning and lubricating.

SUMMARY OF THE INVENTION

Thus, a first objective of the present invention is to provide a composition and a method for cleaning sliding contact surfaces within the valves of a musical wind instrument, such as a trumpet, and contact surfaces within the slide mechanism of a trombone, rapidly and efficiently.

A second objective of the present invention is to provide a composition and a method for additionally lubricating these contact surfaces, so that the composition can be left in place within the valve or slide assembly, leaving the instrument available for immediate play, without a need to clean away the composition and relubricate.

In accordance with a first aspect of the present invention, a method is provided for cleaning and lubricating surfaces in sliding contact in a mechanism within a wind musical instrument, with the method including:

a) opening the mechanism to expose the surfaces in sliding contact;
b) wiping the surfaces in sliding contact dry;
c) coating at least a portion of the sliding surfaces with a cleaning and lubricating composition including abrasive particles, which are preferably diatomaceous earth, a solvent, and a lubricant;
d) closing the mechanism to provide for playing the wind musical instrument; and
e) pumping the mechanism preferably two (2) or three (3) times to cause relative movement between the surfaces in sliding contact in order to coat both surfaces with the inventive composition.

In a first embodiment of the invention, the cleaning and lubricating composition used in step c) is composed essentially of 30-50 percent diatomaceous earth by weight, 0.5-1.5 percent light mineral oil by weight, and 50-70 percent kerosene by weight. In a second embodiment of the invention, the cleaning and lubricating composition is composed essentially of 31-42 percent diatomaceous earth by weight, 0.4-0.7 percent light mineral oil by weight, 38-60 percent kerosene by weight, and an additional portion composed of additives taken from a group composing water, denatured alcohol, cetearyl alcohol, cetyl esters, and propylene glycol.

The method may additionally include, after step e):

f) playing the wind musical instrument until the surfaces in sliding contact have become sticky,
g) opening the mechanism to expose the surfaces in sliding contact;
h) wiping the surfaces in sliding contact dry;
i) coating at least a portion of the sliding surfaces with a conventional lubricant; and
j) closing the mechanism to provide for playing the wind musical instrument.

The method may additionally include, before step c), a method for forming the cleaning and lubricating composition including:

k) mixing a solvent and a lubricant to form a first mixture;
l) adding diatomaceous earth to the first mixture to form a second mixture, which may be composed essentially of about 42.5 percent diatomaceous earth by weight, about 0.6 percent light mineral oil by weight, and about 56.9 percent kerosene by weight;
m) dividing the second mixture into first and second parts; and
n) mixing incremental portions of the second part with the first part until a predetermined level of viscosity within a resulting mixture is reached to form the cleaning and lubricating composition.

Step n) may comprise:

o) mixing an incremental portion of the second part with the first part;
p) determining whether the mixture formed in step o) is beginning to drip through a hole of a predetermined diameter within a wire loop;
q) in response to a determination in step p) that the mixture formed in step o) is not beginning to drip through the wire loop repeating steps o), p), and q); and
r) in response to a determination in step p) that the mixture formed in step o) is beginning to drip through the wire loop, saving the mixture formed in step o) as the cleaning and lubricating composition.

Step n) may additionally comprise mixing one or more additives into the resulting mixture to form the cleaning and lubricating composition, wherein each of the one or more additives is taken from a group composing water, denatured alcohol, cetearyl alcohol, cetyl esters, and propylene glycol.

While a process for making the cleaning and lubricating composition is described as part of the process for cleaning and lubricating sliding contact surfaces in the instrument, there is no implied requirement that the cleaning and lubricating composition must be made in the same location or during the process of lubricating the surfaces. The only requirement is that the cleaning and lubricating composition must be made before it is applied to the surfaces within the instrument.

DETAILED DESCRIPTION OF THE INVENTION

In accordance with the present invention a sticky valve, or a slow slide, of a musical instrument is corrected by opening the valve or slide mechanism, by wiping surfaces having sliding contact within the valve or slide mechanism dry, by applying a cleaning and lubricating composition to these surfaces, and by then closing the valve or slide mechanism so that the instrument can be played. (As the term is used herein, "surfaces having sliding contact" are surfaces of both moving and stationary parts moving against one another within the valve or slide mechanism. Next, the valve or slide is pumped a few times, and the instrument is played until the valve action becomes sticky, or the slide action becomes slow. Then, the valve or slide mechanism is again opened, surfaces having sliding contact within the mechanism are again wiped clean and dry, and lubricated using a conventional lubricant. Conventional lubricants, which are well known to musicians playing wind instruments, include VASOLINE® petroleum jelly, petroleum distillates, and various solutions advertised for lubricating musical instruments. Following this procedure, the instrument is ready to play for an extended time without a need for additional lubrication of the valve or slide. In an instrument having several valves, the individual valves may all be cleaned and lubricated at once, or a valve may be cleaned and lubricated only after it becomes sticky, depending upon the wishes of the musician, the time available, and the need to maintain the instrument in good operating condition.

The cleaning and lubricating composition includes an abrasive substance, a solvent, and a lubricant. Preferably, the abrasive substance is diatomaceous earth, while the solvent is kerosene, which may be deodorized, and while the lubricant is a light mineral oil. The diatomaceous earth is preferably an amorphous type, which may be obtained from a marine deposit.

Diatomaceous earth, which consists of the fossilized remains of diatoms, a type of hard-shelled algae, has been used as a filtration medium for cleaning water, as a mild abrasive in toothpaste and metal polishes, and as an absorbent in cat litter. The typical chemical composition of oven-dried diatomaceous earth includes 80-90% silicon dioxide, 2-4% alumina, and 0.5-2.0% iron oxide. The typical particle size range of diatomaceous earth is 10-200 microns. In the present invention, the abrasive properties of diatomaceous earth provide a means for removing residue from the surfaces having sliding contact within the valve or slide mechanism, while the absorbent property of the diatomaceous earth, arising from its porosity, provides a means for holding the residue within the cleaning and lubricating composition. The diatomaceous earth The diatomaceous earth provides a gentle polishing or honing action on these surfaces.

In accordance with a first embodiment of the invention, the cleaning and lubricating composition is essentially composed of diatomaceous earth, light mineral oil, and kerosene. The cleaning and lubricating composition may be composed essentially of 30-50% diatomaceous earth, 0.5-1.5% light mineral oil, and 50-70% kerosene. Preferably, the cleaning and lubricating composition is composed essentially of 39-43% diatomaceous earth, 0.5-0.7% light mineral oil, and 57-61% kerosene, with all percentages being given by weight. The liquids are mixed with one another before the diatomaceous earth is added.

A process for forming an optimized mixture consistent with the ranges described in the above paragraph begins with preparing a first mixture having about 42.5% diatomaceous earth, 0.6% light mineral oil, and 56.9% kerosene, again with the percentages being given by weight, and a second mixture having about 1.1% light mineral oil and 98.9% kerosene. The second mixture is then added to the first mixture in increments that are thoroughly mixed with the first mixture, with a viscosity of the resulting mixture being checked after each increment is added. As each increment of the second mixture is added to the first mixture, the viscosity of resulting mixture is reduced.

For example, the viscosity of a sample of the resulting mixture is checked by moving a 0.63 mm (0.025 inch) diameter wire, formed into a loop having an inner diameter of 7.0 mm (0.276 inch), through the sample of the resulting mixture and by then determining whether the liquid from the mixture remaining within the loop drips through the loop as the loop is held outside the mixture in a horizontal orientation. It has been determined that a mixture that just begins to drip through the loop under these conditions has a viscosity that is appropriate for use as described above. Thus, the optimized mixture can be obtained by incrementally adding the second mixture to the first mixture until the resulting mixture begins to drip through the loop.

This process of forming an optimized mixture may be used to compensate for variations in the components used to produce the mixture, especially in the diatomaceous earth. After the ratios of components within the optimized mixture have been determined, these ratios may be used to prepare additional batches of the optimized mixture with remaining portions of the batches of components used to form the optimized mixture.

In accordance with a second embodiment of the invention, the cleaning and lubricating composition is formed by mixing diatomaceous earth, light mineral oil, and kerosene in the proportions described above, with additional additives forming 2-25% of the resulting mixture. These additional additives are composed essentially of water, denatured alcohol, cetearyl alcohol, cetyl esters, and propylene glycol, which may be added in proportions equal to one another. Preferably, the cleaning and lubricating fluid is composed essentially of 31-42% diatomaceous earth, 0.4-0.7% light mineral oil, 38-60% kerosene, and 0.5-4% each of water, denatured alcohol, cetearyl alcohol, cetyl esters, and propylene glycol. Again, a mixture of the liquid components may be incrementally added to a mixture containing both the liquid components and the diatomaceous earth, with the viscosity of the resulting combined mixture being checked to obtain an optimized mixture.

Since the cleaning and lubricating composition of either embodiment of the present invention has components that are effective in both the cleaning and lubrication of a valve or slide of a musical instrument, the instrument may be played after cleaning without need to remove a cleaning solution. This capability provides a significant advantage over a conventional method in which the stationary and moving parts of the valve or slide are merely wiped clean and relubricated, in that the cleaning capability of the cleaning and lubricating solution of the present invention provides a much more effective method for removing residue left on the surfaces of the moving and stationary parts, thereby allowing the instrument to be subsequently played for a substantially longer time before it is necessary to repeat the cleaning and lubricating process. This capability further provides a significant advantage over the use of a conventional cleaning composition which must be removed before the instrument is relubricated so that it can be played.

Both the cleaning and lubricating composition of the first embodiment and the cleaning and lubricating compound of the second embodiment, including additives as discussed above, provide similar cleaning capabilities and similar lubricating capabilities affecting the initial playing of the instrument after the cleaning and lubricating process. However, the incorporation of additives in the second embodiment of the invention has been found to extend the time that lubricity is maintained, so that the instrument can continue to be played, by 5-20%.

The cleaning and lubricating composition of either embodiment is effective in instantly and effortlessly allowing moving parts to function normally, because the composition is based upon tribologically sound principles, with the composition forming a boundry line interface between the opposing metal parts. Because the metal surfaces in sliding contact are highly porous, a combination of unique lubricants is stored within and along the surfaces, allowing the metal surfaces to move freely, with a barrier of lubricant on each metal surface, while providing for cleaning, lapping, and honing. Thus the composition of the present invention forms an effortless, self cleaning self lapping, self polishing, self honing product with instant response eliminating significant down time for both the instrument and the musician. The cleaning process is repeatable without fear of increasing close clearances within valve and slide mechanisms. In this regard, there is no comparison between the product of this invention and products now available in the marketplace.

While the invention has been shown in its preferred embodiments and versions with some degree of particularity, it is understood that this description has only been given by way of example, and that many changes can be made without departing from the spirit and scope of the invention, as defined by the appended claims.

The cleaning and lubricating compositions of the present invention are further described in the following examples:

EXAMPLE 1

A liquid mixture was formed by mixing 0.6 cc of light mineral oil with 52 cc of kerosene. This liquid mixture was divided into a first part comprising 45.2 cc and a second part comprising 7.4 cc. Diatomaceous earth having a weight of 28.3 g was then mixed into the first part of the liquid mixture. Incremental portions of the second part were then mixed into the mixture of the first part and diatomaceous earth, with the viscosity of the resulting mixture being checked after adding each of the incremental portions. After the resulting mixture was found to begin to drip through a wire loop having a 7 mm diameter hole, the resulting mixture was applied to a musical instrument valve assembly that had been wiped dry after being found to be sticky. The valve was then reassembled and depressed several times. The musical instrument was then played normally for a first satisfactory period of time before being again found to be sticky. The valve was then disassembled, wiped dry, relubricated with a conventional lubricant, and reassembled. The musical instrument was then played normally for a second satisfactory period of time before being again found to be sticky.

EXAMPLE 2

A liquid mixture was formed by mixing 0.6 cc of light mineral oil with 52 cc of kerosene. This liquid mixture was divided into a first part comprising 45.2 cc and a second part comprising 7.4 cc. Diatomaceous earth having a weight of 28.3 g was then mixed into the first part of the liquid mixture. Incremental portions of the second part were then mixed into the mixture of the first part and diatomaceous earth, with the viscosity of the resulting mixture being checked after adding each of the incremental portions. After the resulting mixture was found to begin to drip through a wire loop having a 7 mm diameter hole, 20 cc of an additive mixture containing equal portions, by weight, of water, denatured alcohol, cetearyl alcohol, cetyl esters, and propolene glycol. The resulting mixture including additives was then applied to a musical instrument valve assembly that had been wiped dry after being found to be sticky. The valve was then reassembled and depressed several times. The musical instrument was then played normally for a first satisfactory period of time before being again found to be sticky. This period of time was found to be about 20% longer than the corresponding period of time found in EXAMPLE 1. The valve was then disassembled, wiped dry, relubricated with a conventional lubricant, and reassembled. The musical instrument was then played normally for a second satisfactory period of time before being again found to be sticky.

What is claimed is:

1. A method for cleaning and lubricating valves and slides within musical instruments comprising:

providing a self-cleaning, self-polishing, self-lapping and self-honing composition consisting of from 30-50 percent by weight diatomaceous earth, from 0.5-1.5 percent by weight of light mineral oil, and from 50-70 percent by weight kerosene, having a viscosity which permits said composition to drip through a 7.0 mm loop formed from 0.63 mm wire;

exposing the valves and slides having surfaces with sliding contact within said musical instruments;

wiping said surfaces in sliding contact dry;

applying said composition to at least a portion of each said sliding surfaces to form a barrier of lubricant thereon, while providing for cleaning, lapping and honing; and closing said musical instrument;

whereby the instrument is returned to a playable condition while leaving in place said self-cleaning, self-polishing, self-lapping and self-honing composition, thereby enabling said musical instrument to be played for a substantial period of time before further maintenance is required.

2. The method of claim 1, wherein said self-cleaning, self-polishing, self-lapping and self-honing composition consists of from 39-43 percent by weight diatomaceous earth, from 0.5-0.7 percent by weight of light mineral oil, and from 57-61 percent by weight kerosene.

3. A method for cleaning and lubricating valves and slides within musical instruments comprising:

providing a self-cleaning, self-polishing, self-lapping and self-honing composition consisting of from 30-50 percent by weight diatomaceous earth, from 0.5-1.5 percent by weight of light mineral oil, from 50-70 percent by weight kerosene, and from 2-25 percent by weight additional additives selected from water, denatured alcohol, cetearyl alcohol, cetyl esters, propylene glycol, and mixtures thereof, having a viscosity which permits said composition to drip through a 7.0 mm loop formed from 0.63 mm wire;

exposing the valves and slides having surfaces with sliding contact within said musical instruments;

wiping said surfaces in sliding contact dry;

applying said composition to at least a portion of each said sliding surfaces to form a barrier of lubricant thereon, while providing for cleaning, lapping and honing; and closing said musical instrument;

whereby the instrument is returned to a playable condition while leaving in place said self-cleaning, self-polishing, self-lapping and self-honing composition, thereby enabling said musical instrument to be played for a substantial period of time before further maintenance is required.

4. The method of claim 3, wherein said self-cleaning, self-polishing, self-lapping and self-honing composition consisting of from 31-42 percent by weight diatomaceous earth, from 0.4-0.7 percent by weight of light mineral oil, from 38-60 percent by weight kerosene, and from 0.5-4 percent by weight each of water, denatured alcohol, cetearyl alcohol, cetyl esters, and propylene glycol.

* * * * *